US005971100A

United States Patent [19]

DeLeon et al.

[11] Patent Number: 5,971,100

[45] Date of Patent: Oct. 26, 1999

[54] LADDER MOUNT AND GUTTER SAVER

[75] Inventors: Michael R. DeLeon, Sandy City, Calif.; James W. Owens, 600 Redwood Ave., Sand City, Calif. 93955; David J. Salwasser, Sand City, Calif.

[73] Assignee: James W. Owens, Sand City, Calif.

[21] Appl. No.: 08/328,708

[22] Filed: Oct. 25, 1994

[51] Int. Cl.[6] ..... E04G 3/00

[52] U.S. Cl. ..... 182/107; 182/214

[58] Field of Search ..... 182/107, 214, 182/229; 248/48.1, 48.2; 52/11

[56] References Cited

U.S. PATENT DOCUMENTS

| | | | |
|---|---|---|---|
| 4,601,365 | 7/1986 | Davis . | |
| 4,813,515 | 3/1989 | Wigington | 52/11 X |
| 5,035,092 | 7/1991 | Brant . | |
| 5,169,098 | 12/1992 | Samuelson . | |
| 5,215,163 | 6/1993 | Kent | 182/214 X |

FOREIGN PATENT DOCUMENTS

| | | | |
|---|---|---|---|
| 493868 | 2/1978 | Australia | 182/214 |

*Primary Examiner*—Alvin Chin-Shue

*Attorney, Agent, or Firm*—James Creighton Wray; Meera P. Narasimhan

[57] ABSTRACT

A ladder securing support and guard for rain gutters is fastened to a facia board of a house and extends over a rain gutter for protecting the gutter. The present invention has a front ladder engaging bar and a rear support bar. The two bars are connected to each other at their extremities by two cross-members. These cross-members are curved vertically in parallel vertical planes to accommodate complementary cross-sectional curves of a gutter. The rear bar has a means for securing the apparatus to a facia board connected to an end of a rafter under a roof extension on a house, such as a bolt hole and multiple holes for receiving a bolt or nails secured to the facia. Guides extend outward from the ends of the front bar for securing uprights of a ladder therebetween and also to provide for detection of the apparatus from the ground. The present invention can have a pair of cross-rails in the middle of the apparatus that hold an O-ring for tying and securing a ladder. The cross-rails may also be curved to accommodate a complementary shape of a gutter. The gutter is protected because the ladder rests on the front bar of the apparatus and never touches the gutter. No pressure is exerted on the gutter. The apparatus increases safety and saves time and money.

14 Claims, 2 Drawing Sheets

LADDER MOUNT AND GUTTER SAVER

BACKGROUND OF THE INVENTION

Safety problems and gutter damage consistently accompany construction and maintenance projects requiring climbing on a roof. Ladders are leaned against the side of a building with the upright rails resting against an edge of the roof or against an underlying gutter. Roof edges can be damaged by ladders. Even with support devices positioned in gutters, the gutters remain vulnerable to dents, deformations and collapse.

Existing gutter protectors have proven inadequate. Successful operation involves placing supports inside the gutter and leaning a ladder against the gutter at the buttressed region. Many of these supports are easily dislodged and are incompatible with long-term positioning in the gutter because their dam-like design elements impede rainwater. Most gutter protectors are designed to be transportable rather than permanent fixtures and thus sacrifice rigidity for a design favoring transportability. The component parts of existing gutter supports are generally straight bars with designs susceptible to fatigue. Most important, existing gutter guards allow pressure to be exerted on the gutter and thereby weaken, distort and dent the gutter.

Needs exist for devices that protect rain gutters and increase worker safety on roof-related activities. Rain gutters are usually painted and constructed of a supple material, such as aluminum. When ladders exert pressure on the gutter, the paint tends to chip or crack. Dents develop, and the gutter tends to bend with poor aesthetic and functional results. An apparatus is needed that will give the gutter support, prevent the ladder from actually touching the gutter, and limit or eliminate direct applied pressure to the gutter.

Many tradesmen, including roofers, electricians and other contractors, as well as property owners, require sporadic and immediate access to the roofs of buildings. Some projects and company safety policies require gutters to be removed before climbing on the roof. This wastes both time and money and increases damage risks to the gutters. A device that eliminates the need for these removal measures will increase productivity, decrease costs, and enhance safety.

Worker productivity will increase and gutter damage will decrease by having a ladder support and gutter protector permanently affixed to the building. A roofer, mechanic or tradesman can climb onto the roof immediately upon entering the job site without first having to install gutter protectors. A means of guard recognition from the ground is also needed for those unfamiliar with the house to determine the place of roof access.

Safety is a primary concern for those using ladders to climb onto a roof. Even when positioned on level ground the ladder is subject to toppling sideways when workers ascend and descend the ladder or when workers leave or re-access the ladder from the roof. When poor weather conditions, such as wind, arise, workers can become stranded when a ladder falls while working on the roof. A means for connecting the ladder securely to the house while also not damaging the house is needed to allay those concerns. Existing safety devices for tying ladders to houses are inadequate because of implementation difficulties. Safety features need to be easy to use and blatantly obvious or else workers will forget to use or purposefully disregard the measures.

A need exists for a ladder support and rain gutter guard that eliminates ladder contact with the gutter, has a structure compatible with long-time installation and use, and can be fitted with rigid safety features.

SUMMARY OF THE INVENTION

The new ladder support protects rain gutters and promotes worker safety during roof-related activities. The ladder mount and gutter protector has a front bar, a rear bar, and a pair of cross-members connecting the front and rear bars. The cross-members are constructed such that the front bar extends over the lip of the gutter. The rear bar is securely fastened to the facia board and rafter ends of the roof. An O-ring and accompanying cross-rails are added features of the present invention for tying the ladder to the house. A pair of guides extends outward from the front bar for guiding the ladder against lateral slipping, providing support to the ladder, and assisting in ground recognition of the apparatus. The present invention has beneficial applications for builders, roofers, gutter contractors and building owners. Once installed, the gutter guard allows access to the roof without a ladder ever touching the gutter. The ladder uprights rest on the front bar that overhangs the front lip of the gutter. No pressure is exerted on the gutter. Rather, all of the force is delivered through the cross-members and cross-rails to the rear bar that is attached to the facia board or rafter ends of a roof of a building.

The rear bar is securely fastened to the facia board or rafter ends of the roof. Mechanical fasteners such as nails, bolts and screws allow for the apparatus to be connected to the building for extended periods of time. The tabs extending from the front bar are visible from the ground and give workers a standard place for roof access. These tabs also serve as guides for the ladder and limit horizontal movement of the ladder.

Being securely fastened to the building, safety ropes can be connected to the ladder mount and gutter protector. A tie rope from the ladder can wrap around an O-ring centrally located on the guard. Cross-rails extending from the rear bar to the front bar carry the O-ring between them. The cross-rails can have the same curved configurations as the cross-members, thus giving added stability and strength to the gutter protector.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
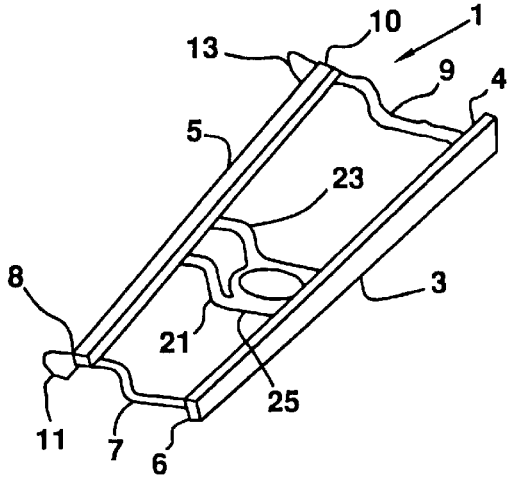
FIG. 1 is a lower frontal perspective view a ladder mount and rain gutter protector.

Referring to the drawings, FIG. 1 shows a preferred embodiment of the ladder mount and gutter saver 1. The apparatus 1 has a rear bar 3, a front bar 5, and a pair of cross-members 7, 9. The rear bar 3 is connected to a wooden member of a facia 19 or a rafter end under a roof extension of a house by a strong mechanical means, such as bolts or nails. Any rigid material can be used to construct the ladder mount and gutter protector 1. Preferred embodiments of the present invention are made of metal, fiberglass, plastic and wood.

Figure 3:
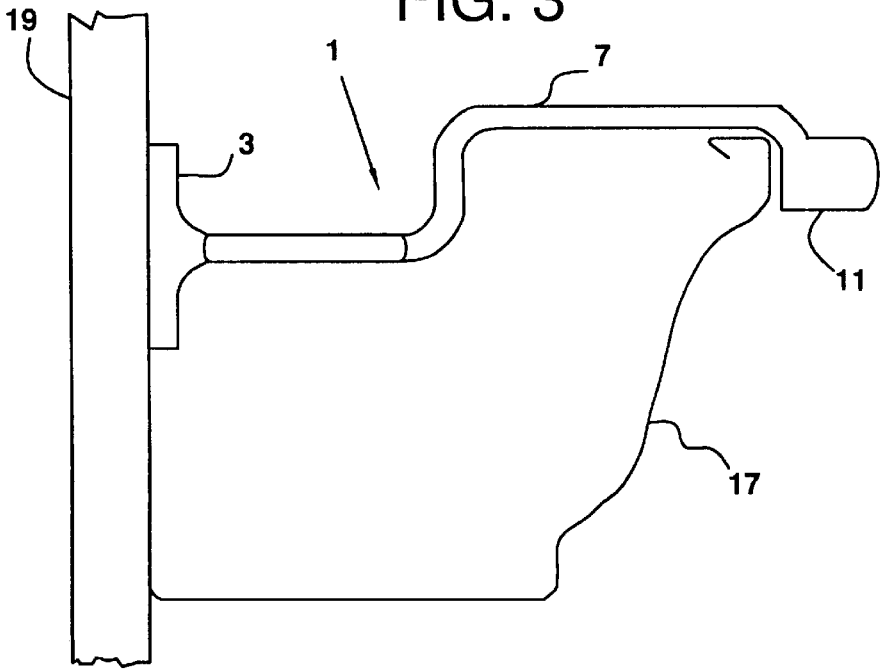
FIG. 3 is a side view of the apparatus positioned in a rain gutter.

FIG. 3 is a side illustration of the present invention. The rear bar 3 is connected through the back of a gutter 17 to a wooden member of the facia 19. Cross-members 7,9 extend outward from the rear bar 3 and connect the rear bar 3 to a front ladder contacting and supporting bar 5. Preferred embodiments of the ladder mount and gutter protector 1 have left 9 and right 7 cross-members that are curved to conform with the shape of conventional gutters 17. The vertical curvatures are in parallel vertical planes. The curved shape is designed to withstand pressures and prevent fatigue in the apparatus 1. The cross-members 7, 9 extend upward to allow the front bar 5 to rest outside and above the front lip of the gutter 17.

The front bar 5 lies outside of the gutter 17, above its front lip. A ladder rests on the front bar 5, and all pressures exerted on the front bar 5 are delivered through the cross-members 7, 9 to the rear bar 3 and the facia 19 or rafter end. The ladder never touches the gutter 17, and the gutter 17 is never stressed.

For ground recognition, the ladder mount and gutter saver 1 has a pair of guides 11, 13 extending outward from opposite ends of the front bar 5. The guides 11, 13 are separated by a distance greater than or equal to the width of a ladder. The uprights of the ladder can be positioned against the front bar 5 between the guides 11, 13. The guides 11, 13 prevent the ladder from sliding off the front bar 5 and tumbling to the ground.

Figure 2:
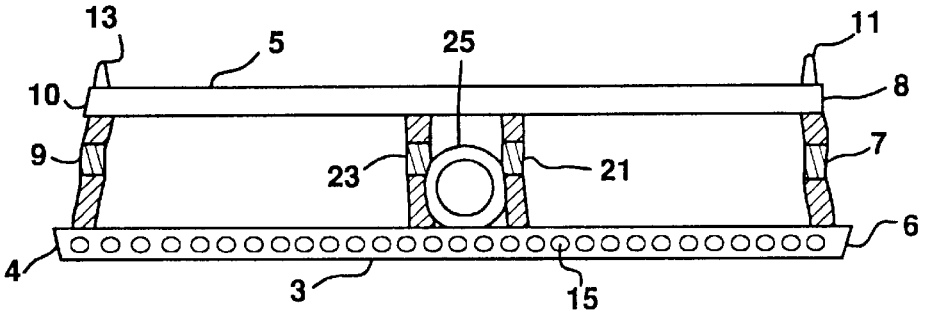
FIG. 2 is an overhead perspective view of the ladder mount and gutter protector.
Figure 4:
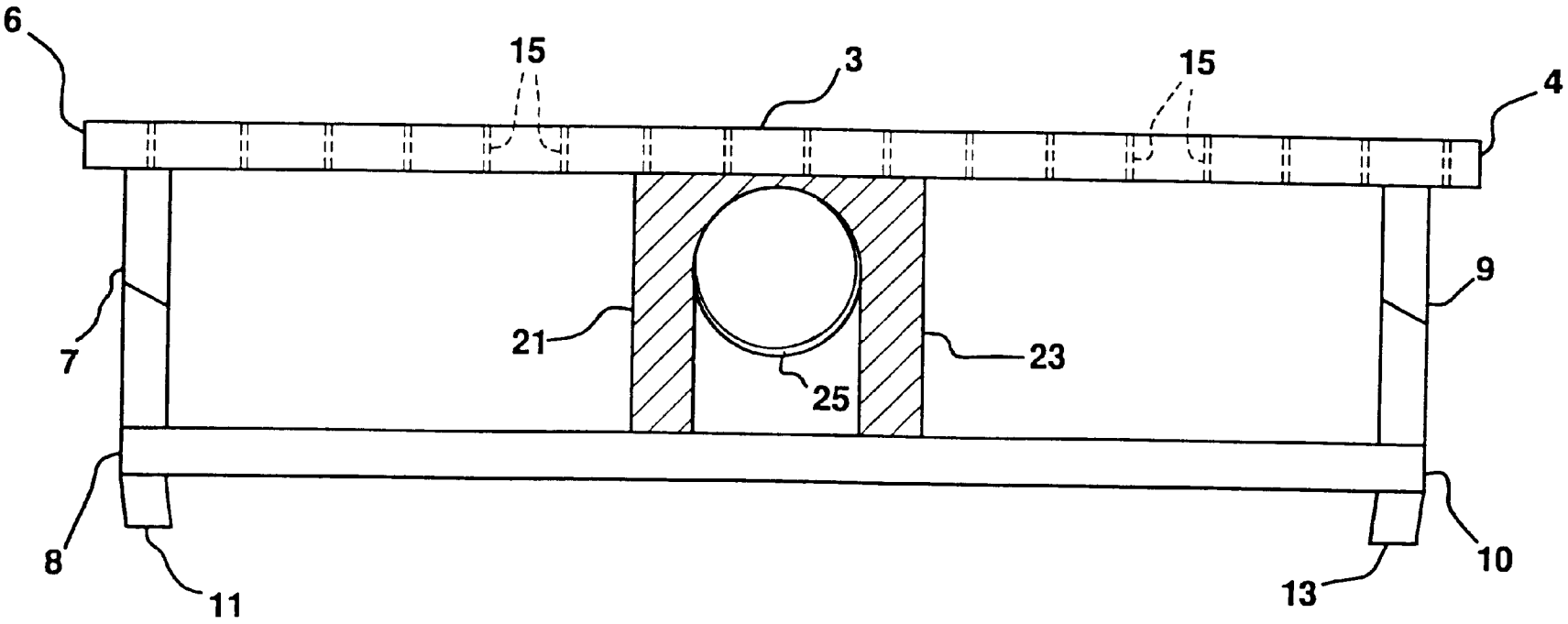
FIG. 4 is a plan view of the present invention having cross-rails and an O-ring.

Referring to FIGS. 2 and 4, the rear bar 3 has a right end 4 and a left end 6. Similarly, the front bar 5 has a first end 8 and a second end 10. A pair of cross-members 7, 9 extends from the rear bar 3 to the front bar 5 at or proximate to these ends. FIGS. 2 and 4 also show a preferred embodiment of the ladder mount and gutter saver 1 that has incorporated an O-ring 25 as a safety feature. A left cross-rail 21 and a right cross-rail 23 are centrally positioned in the apparatus 1. Both cross-rails 21, 23 extend from the rear bar 3 to the front bar 5. Preferred embodiments of the apparatus 1 have cross-rails 21, 23 with vertical curvatures and lie in parallel planes. The cross-rails 21, 23 can be designed with vertically-curved configurations similar or identical to the curvatures of the cross-members 7, 9. An O-ring 25 is connected to the cross-rails 21, 23, with the opening of the O-ring 25 lying between the cross-rails 21, 23. A preferred embodiment of the present invention positions the O-ring 25 closer to the rear bar 3 than the front bar 5 and has the O-ring 25 welded to the cross-rails 21, 23.

In FIG. 2, a preferred means for connecting the ladder mount and gutter saver 1 to a wooden member of a facia 19 or a rafter end is disclosed. A plurality of holes 15 is located in the rear bar 3. The holes 15 can receive fasteners, such as bolts, screws and nails. The fasteners extend through the holes 15 and back of the gutter 17 to the facia 19 or rafter end under a roof extension of a building. A second means for connecting the apparatus to the building is to use a lag bolt. Other means of fastening the apparatus to the building can be used, with the choice depending on frequency of use and time period of installation. In addition, the ladder mount and gutter protector 1 can be connected directly to the rafter end or facia 19 of a house in the absence of a gutter 17.

While the invention has been described with reference to specific embodiments, modifications and variations of the invention may be constructed without departing from the scope of the invention, which is defined in the following claims.

We claim:

1. An apparatus for securing ladders against buildings and protecting rain gutters comprising a rear wall-mountable bar having a left end and a right end, a front ladder contacting and supporting bar having a first end and a second end, a left cross-member connected to the rear bar proximate to the left end and to the front bar proximate to the first end, a right cross-member connected to the rear bar proximate to the right end and to the front bar proximate to the second end, a left guide bar extending outward from the first end of the front bar, and a right guide extending outward from the second end of the front bar, wherein the rear bar is fitted with fasteners for connecting the apparatus to a facia board or a rafter end under a roof of a building.

2. The apparatus of claim 1, wherein the right and left cross-members are curved to accommodate complementary curvatures of gutters.

3. The apparatus of claim 1, wherein the cross-members are curved such that the front bar is positioned outside of a gutter near a top edge of a gutter, thus allowing a ladder to be extended to the roof without touching the gutter.

4. The apparatus of claim 1, wherein the left and right guides are positioned on the front bar a distance greater than or equivalent to the width of a ladder for receiving a pair of uprights of the ladder and preventing the ladder from sliding off the apparatus.

5. The apparatus of claim 1, wherein the apparatus is made from a material selected from the group consisting of wood, metal, fiberglass and plastic.

6. The apparatus of claim 1, further comprising a first cross-rail and a second cross-rail, the cross-rails extending from the rear bar to the front bar, positioned and secured between the left and right cross-members, and the first cross-rail positioned a distance from the left cross-member that is equal to the distance of the second cross-rail from the right cross-member.

7. The apparatus of claim 6, wherein the cross-rails are curved to accommodate curvatures of complementary gutter.

8. The apparatus of claim 7, wherein the cross-rails are curved in a configuration identical to the cross-members.

9. The apparatus of claim 7, wherein vertical curvatures of the cross-rails and the cross-members are in parallel vertical planes.

10. An apparatus for securing ladders against buildings and protecting rain gutters comprising a rear wall-mounted bar having a left end and a right end, a front ladder contacting and supporting bar having a first end and a second end, a left cross-member connected to the rear bar proximate to the left end and to the front bar proximate to the first end, a right cross-member connected to the rear bar proximate to the right end and to the front bar proximate to the second end, a left guide extending outward from the first end of the front bar, and a right guide extending outward from the second end of the front bar, wherein multiple holes are positioned in the rear bar for receiving nails or bolts for fastening the apparatus to the facia board or rafter end of a roof of a building.

11. An apparatus for securing ladders against buildings and protecting rain gutters comprising a rear bar having a left end and a right end, apertures in the rear bar for receiving fasteners to secure the apparatus to a building, a front ladder contacting and supporting bar having a first end and a second end, a left cross-member having a vertical curvature and connected to the rear bar proximate to the left end and to the front bar proximate to the first end, a right cross-member having a vertical curvature and connected to the rear bar proximate to the right end and to the front bar proximate to the second end, a left guide extending outward from the first end of the front bar, a right guide extending outward from the second end of the front bar, a first cross-rail and a second cross-rail, the cross-rails extending from the rear bar to the front bar and having vertical curvatures, secured and positioned between the left and right cross-members, with the first cross-rail positioned a distance from the left cross-member that is equal to the distance of the second cross-rail from the right cross-member, and an O-ring, connected to the cross-rails for receiving a rope from a ladder and tying the rope between the ladder and the O-ring.

12. An apparatus for securing ladders against buildings and protecting rain gutters comprising a rear wall-mountable bar having a left end and a right end, a front ladder contacting and supporting bar having a first end and a second end, a left cross-member connected to the rear bar proximate to the left end and to the front bar proximate to the first end, a right cross-member connected to the rear bar proximate to the right end and to the front bar proximate to the second end, a left guide extending outward from the first end of the front bar, and a right guide extending outward from the second end of the front bar, further comprising a first cross-rail and a second cross-rail, the cross-rails extending from the rear bar to the front bar, positioned and secured between the left and right cross-members, and the first cross-rail positioned a distance from the left cross-member that is equal to the distance of the second cross-rail from the right cross-member, further comprising an O-ring connected to the first and second cross-rails for receiving a rope from a ladder and tying the rope between the ladder and the O-ring.

13. The apparatus of claim 12, wherein the O-ring is connected to the cross-rails closer to the rear bar than to the front bar.

14. The apparatus of claim 6, wherein the O-ring is welded to the cross-rails.

* * * * *